US007930983B2

(12) United States Patent
Okamoto

(10) Patent No.: US 7,930,983 B2
(45) Date of Patent: Apr. 26, 2011

(54) SEWING MACHINE, DATA CREATION APPARATUS AND EMBROIDERY METHOD FOR SEWING ON CURVED SURFACE

(75) Inventor: Takuya Okamoto, Komaki (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 1296 days.

(21) Appl. No.: 11/500,921

(22) Filed: Aug. 8, 2006

(65) Prior Publication Data

US 2007/0034127 A1 Feb. 15, 2007

(30) Foreign Application Priority Data

Aug. 9, 2005 (JP) ..... 2005-230652

(51) Int. Cl.
*D05B 19/02* (2006.01)
*D05C 5/02* (2006.01)

(52) U.S. Cl. ..... 112/470.18; 700/138

(58) Field of Classification Search ..... 112/2, 102, 112/102.5, 470.01–470.07, 475.19; 700/136–138
See application file for complete search history.

(56) References Cited

U.S. PATENT DOCUMENTS 4,352,334 A * 10/1982 Childs et al. ..... 112/475.19
4,444,135 A * 4/1984 Yanagi et al. ..... 112/470.04
4,742,786 A * 5/1988 Hashimoto et al. ..... 112/102.5
4,849,902 A * 7/1989 Yokoe et al. ..... 112/470.04
4,915,041 A * 4/1990 Takenoya ..... 112/102.5
6,170,413 B1 * 1/2001 Hirose ..... 112/102.5
7,080,602 B2 * 7/2006 Kawaguchi et al. ..... 112/103
2002/0038621 A1 * 4/2002 Ozeki ..... 112/103
2005/0263055 A1 * 12/2005 Terao ..... 112/470.14

FOREIGN PATENT DOCUMENTS

JP 2-251660 A 10/1990
JP 7-238465 A 9/1995
JP 8-209523 A 8/1996
JP 2001-17760 A 1/2001

* cited by examiner

*Primary Examiner* — Ismael Izaguirre

(74) *Attorney, Agent, or Firm* — Rossi, Kimms & McDowell LLP

(57) ABSTRACT

Sewing workpiece is set on a holding frame in such a manner that a predetermined sewing reference line of the sewing workpiece forms an inclination of a given angle δ relative to a plane perpendicular to a rotation axis of the holding frame. Desired sewing pattern data are corrected in accordance with a predetermined correction function with the given angle δ as a variable. Sewing is performed onto the sewing workpiece by the holding frame being relatively rotated and linearly moved in accordance with the corrected sewing pattern data. Thus, a desired pattern corresponding to the sewing pattern data can be sewn onto the workpiece in generally parallel relation to the predetermined sewing reference line.

9 Claims, 9 Drawing Sheets

SEWING MACHINE, DATA CREATION APPARATUS AND EMBROIDERY METHOD FOR SEWING ON CURVED SURFACE

BACKGROUND OF THE INVENTION

The present invention relates to sewing machines for embroidering/sewing patterns onto curved surfaces, such as peripheral surfaces of crowns of headwear or hats. More particularly, the present invention relates a sewing machine including a means for correcting embroidery or sewing data in accordance with an embroidering or sewing workpiece, as well as a data creation apparatus, sewing method and program usable for such a sewing machine.

When embroider a substantially-cylindrical embroidering workpiece, such as a hat, it has been conventional to detachably attach a cylindrical embroidery frame (e.g., cap or hat frame), having the embroidering workpiece set thereon, to a drive ring that is driven rotationally and linearly along a rotation axis in accordance with a desired embroidery pattern. FIG. 8 is a perspective view showing an outer appearance of an example of a conventional single-head compact sewing machine to which a cap frame is attachable. Machine head 1 is provided with a plurality of sewing needles to permit a selection from among a plurality of thread colors. Beneath the machine head 1, there are provided a drive ring 2 that is driven rotationally and linearly along a rotation axis in accordance with a desired embroidery pattern, and a support plate 3 that is fixed within an interior space of the drive ring 2 for supporting an embroidering workpiece from below the workpiece at a needle drop location (i.e., sewing position). Rotary hook base (not shown) is provided beneath the support plate 3. FIG. 9 is an enlarged view showing the drive ring 2 and support plate 3, as well as a cap frame 4 detachably attached to the drive ring 2. The drive ring 2 is reciprocatively rotated via a transmission wire 23 in response to reciprocative linear movement, in an X-axis direction, of an X-axis drive plate 21, and it is also reciprocatively moved along a rotation axis in response to reciprocative linear movement, in a Y-axis direction, of a Y-axis drive plate 22. As know in the art, the X-axis and Y-axis drive plates 21 and 22 are driven in accordance with desired embroidery pattern data.

The cap frame 4 includes a cylindrical supporting frame section 41 on which an opening (free end) portion of the hat (in this case, cap) is placed and set, and a band-shaped pressing frame section 42 for pressing the periphery of the opening portion of the cap against the supporting frame section 41 to thereby hold the cap. In the illustrated example of FIG. 9, the supporting frame section 41 has a free end 41*a* that forms a plane perpendicular to a horizontal rotation axis of the supporting frame section 41; that is, the free end 41*a* of the supporting frame section 41 agrees with a rotational circumferential direction of the cap frame 4. FIG. 10 is a side view showing the cap frame 4, having the cap C set thereon, attached to the drive ring 2. The opening (free end) portion of the cap C is set along the free end 41*a* of the supporting frame section 41 and then pressed by the band-shaped pressing frame section 42 radially inward from outside the opening portion. In this manner, the cap C can be set in such a manner that its opening (free end) portion agrees with the rotational circumferential direction of the cap frame 4, i.e. with no inclination angle relative to a plane perpendicular to the rotation axis of the cap frame 4. Such a type of cap frame is disclosed in, for example, Japanese Patent Application Laid-open Nos. HEI-2-251660, HEI-8-209523 and 2001-17760 (herein after referred to as patent literatures 1, 2 and 3, respectively).

As a recent trend of the shape of caps, there have been marketed caps having a crown narrowing to the top in a cone shape as compared to the traditional cylindrical crown as depicted in FIG. 12 by a phantom line C'. If such a type of cap (hereinafter referred to as "new-type cap") C is embroidered by being set on the conventional cap frame 4 as shown in FIG. 10, desired embroidery can not be performed nicely due to various problems as set forth below. Namely, the new-type cap C can keep a conical inclination, as indicated by a two-dot-dash line, when the new-type cap C is set on the cap frame 4 alone. However, when the cap frame 4 with the cap C set thereon is attached to the drive ring 2, a near-top region of the peripheral surface of the cap crown is strongly pressed against the front edge of the support plate 3 so that the near-top region of the peripheral surface of the cap crown is forced radially outwardly. Thus, when the cap frame 4 is being driven to rotate, the cap fabric tends to be prevented from moving smoothly with the rotating cap frame 4 due to contact resistance between the inner surface of the cap C and the support plate 3, which would often cause a thread breakage and prevent an embroidery pattern from being made as indicated by embroidery data. Such problems would sometimes result in defective products.

Further, in performing embroidery on a region of the new-type cap C adjacent to the base of a visor (i.e., region indicated by an arrow P in FIG. 10), the cap frame 4 is pushed out toward the front (in a Y direction in FIG. 1) together with the drive ring 2. At that time, the visor of the new-type cap C, pushed out toward the front together with the cap frame 4, contacts a guide plate 6 that is provided to buffer abutment of the visor against the rear surface of a machine arm 5, so that contact resistance between the visor and the guide plate 6 too would adversely influence the sewing. If the visor of the cap C is inclined away from the guide plate 6 instead of extending upward in contact with the guide plate 6 as shown in FIG. 10, the aforementioned inconvenience can be avoided; however, the conventional techniques shown in patent literatures 1-3 identified above are not so arranged.

Japanese Patent Application Laid-open Publication No. HEI-7-238465 (patent literature 4) discloses a technique where the free end of the supporting frame section of the cap frame for holding the new-type cap C is inclined in conformity with an inclination angle δ of the peripheral surface of the crown of the cap C as illustrated in FIG. 11. With such an inclination, the visor of the cap C can be positioned away from the guide plate 6 instead of extending upward in contact with the guide plate 6 as shown in FIG. 10. Because the visor of the cap C can be thus prevented from contacting the guide plate 6, the technique disclosed in patent literature 4 can avoid the aforementioned inconvenience.

However, with the technique disclosed in patent literature 4, desired embroidery sewing is performed on the peripheral surface of the crown of the new-type cap C, set on the cap frame with its visor inclined, in accordance with embroidery data created on the assumption that the visor is not inclined. Thus, an embroidery pattern formed on the cap as a result of the sewing (i.e., sewn embroidery pattern) would have unwanted deformation. Namely, if an embroidery pattern comprising a horizontal straight string of letters as illustrated in (a) of FIG. 7 is sewn onto the peripheral surface of the crown of the new-type cap C, set on the cap frame with its visor inclined, in accordance with the embroidery data created on the assumption that the visor is not inclined, then the sewn embroidery pattern would be undesirably curved or deformed as illustrated in (b) of FIG. 7.

SUMMARY OF THE INVENTION

In view of the foregoing, it is an object of the present invention to provide a sewing machine which is designed to embroider/sew a workpiece having an curved surface, such as a peripheral surface of a crown of a hat and which can reliably avoid deformation of a sewn embroidery pattern even in a case where the sewing workpiece is set on a workpiece holding frame with a to-be-sewn surface of the workpiece inclined as necessary, as well as a sewing pattern data creation apparatus, sewing method and program usable for such a sewing machine.

In order to accomplish the above-mentioned object, the present invention provides a sewing machine, which comprises: a holding frame for setting thereon a sewing workpiece having a curved surface, the holding frame being rotatable and linearly movable relative to a sewing position; a drive mechanism for relatively rotating and linearly moving the holding frame in accordance with desired sewing pattern data; a mounting member adapted to set the sewing workpiece, having the curved surface, on the holding frame in such a manner that a predetermined sewing reference line of the sewing workpiece forms an inclination of a given angle (δ) relative to a plane perpendicular to a rotation axis of the holding frame; and a data correction section for correcting the desired sewing pattern data in accordance with a predetermined correction function with the given angle (δ) as a variable. In this invention, a desired sewing pattern is sewn onto the sewing workpiece by the holding frame being relatively rotated and linearly moved in accordance with the sewing pattern data corrected by the data correction section.

According to the present invention, a desired sewing workpiece, having a curved surface, is set on the holding frame in such a manner that the predetermined sewing reference line of the sewing workpiece forms an inclination of a given angle (δ) relative to the plane perpendicular to the rotation axis of the holding frame. Desired sewing pattern data are corrected in accordance with a predetermined correction function with the given angle (δ) as a variable. Sewing is performed onto the sewing workpiece by the holding frame being relatively rotated and linearly moved in accordance with the corrected sewing pattern data. Thus, even where the sewing workpiece is set on the holding frame with its curved surface to be sewn inclined at the given angle (δ), the desired pattern can be sewn with no unwanted deformation, because the sewing pattern data are corrected in accordance with the given angle (δ).

The present invention can also be implemented as a data correction apparatus for converting the sewing pattern data (such as a punching apparatus or embroidery data creation apparatus). Namely, the data creation apparatus of the present invention comprises a data correction section for correcting the desired sewing pattern data in accordance with the predetermined correction function with the given angle (δ) as a variable. The sewing pattern data corrected by the data correction section are supplied to the sewing machine, so that the sewing machine sews a desired sewing pattern onto the sewing workpiece, set on the holding frame with the inclination of the given angle (δ), by the holding frame being relatively rotated and linearly moved in accordance with the corrected sewing pattern data. Thus, the desired pattern can be sewn with no unwanted deformation.

The present invention can also be implemented as a sewing method for use in a sewing machine. The sewing method of the present invention comprises: a step of setting the sewing workpiece, having the curved surface, on the holding frame in such a manner that a predetermined sewing reference line of the sewing workpiece forms an inclination of a given angle (δ) relative to a plane perpendicular to a rotation axis of the holding frame; a step of correcting the desired sewing pattern data in accordance with a predetermined correction function with the given angle (δ) as a variable; and a step of supplying the sewing pattern data, corrected by the step of correcting, to the sewing machine so that a desired sewing pattern is sewn onto the sewing workpiece by the holding frame of the sewing machine being relatively rotated and linearly moved in accordance with the corrected sewing pattern data.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
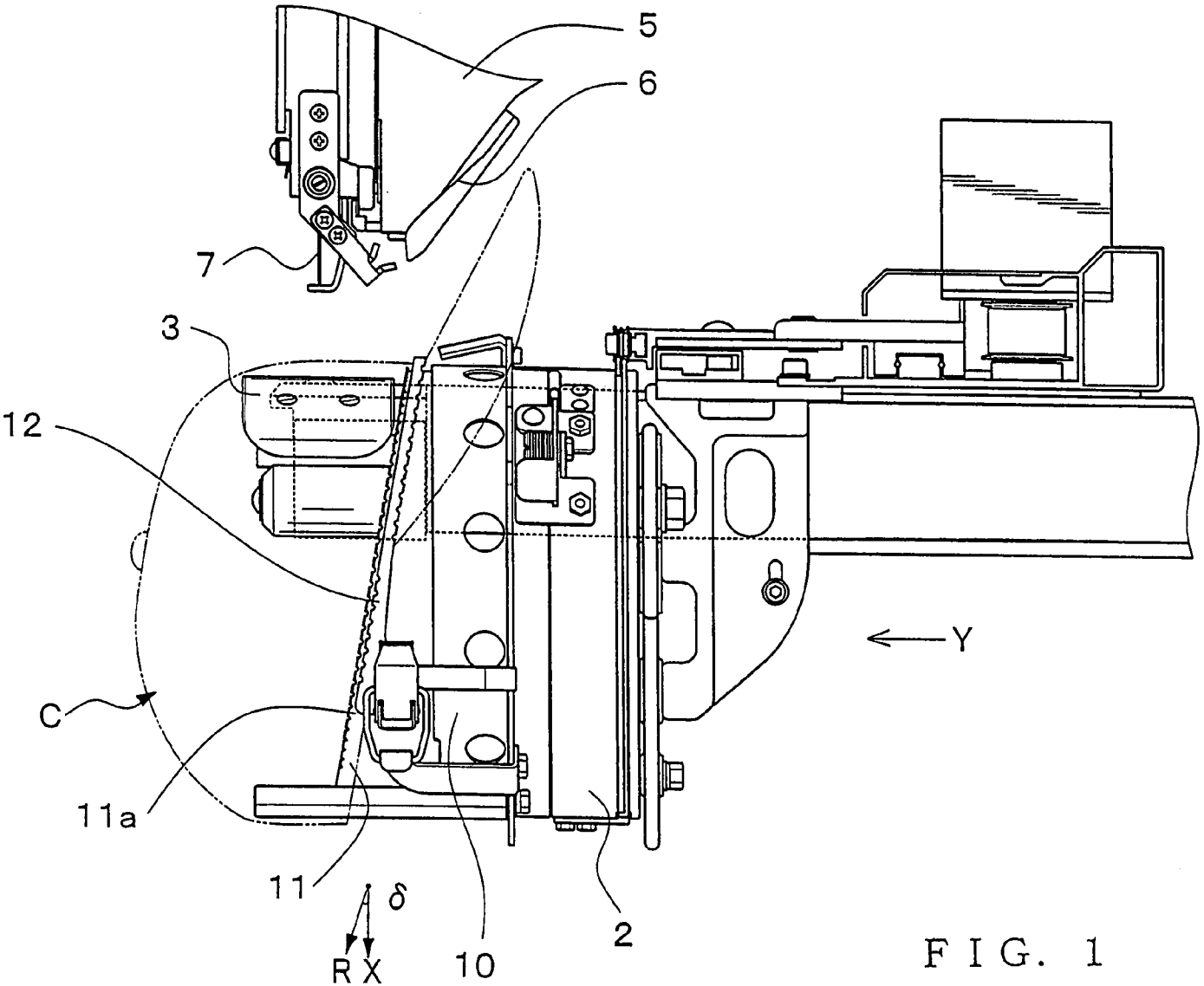
FIG. 1 is a side view of a sewing machine in accordance with an embodiment of the present invention, which particularly shows a workpiece holding frame (cap frame) attached to a drive ring.
Figure 9:
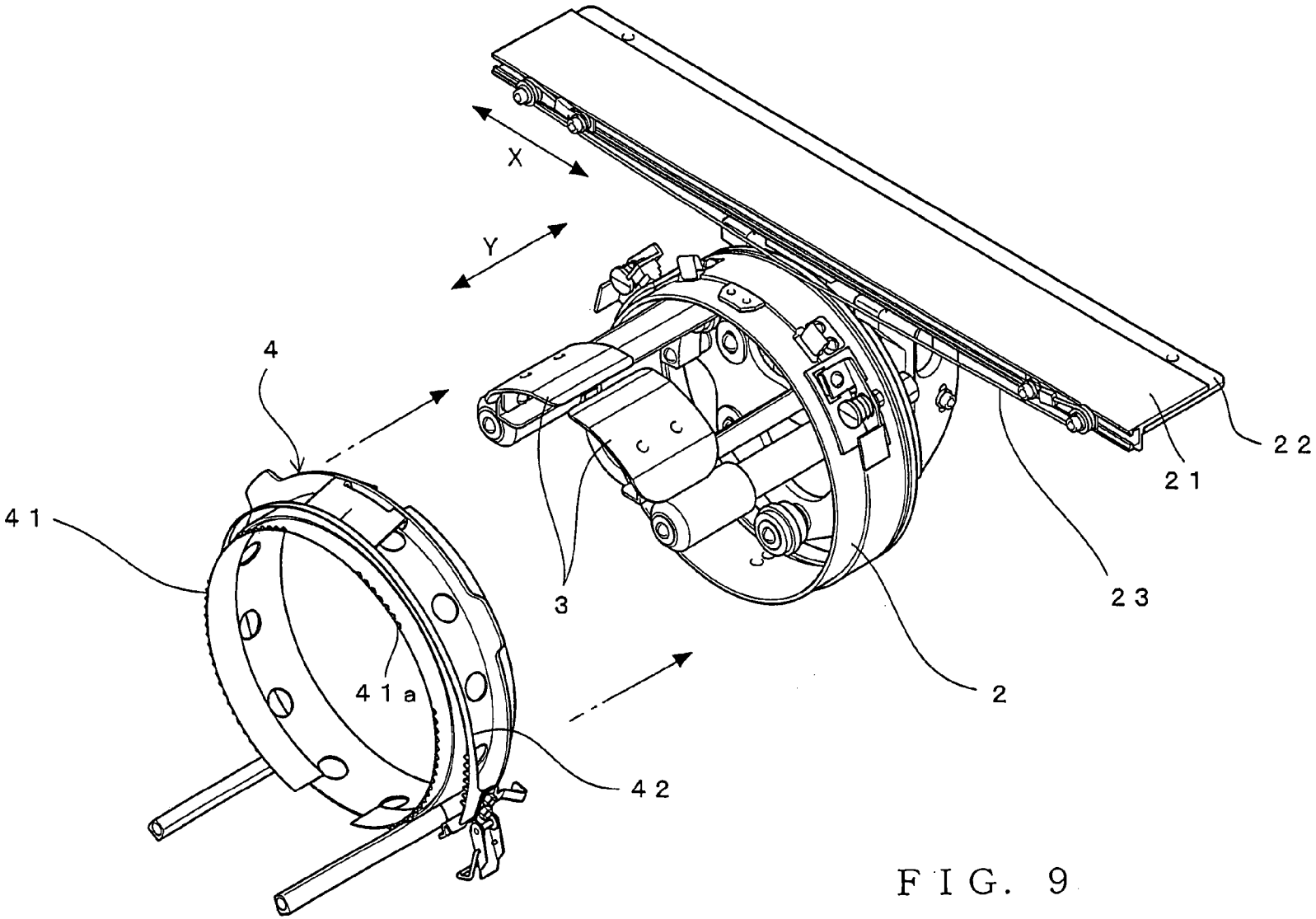
FIG. 9 is an enlarged perspective view showing a drive mechanism for driving the cap frame in a rotational direction and front-rear direction.
Figure 10:
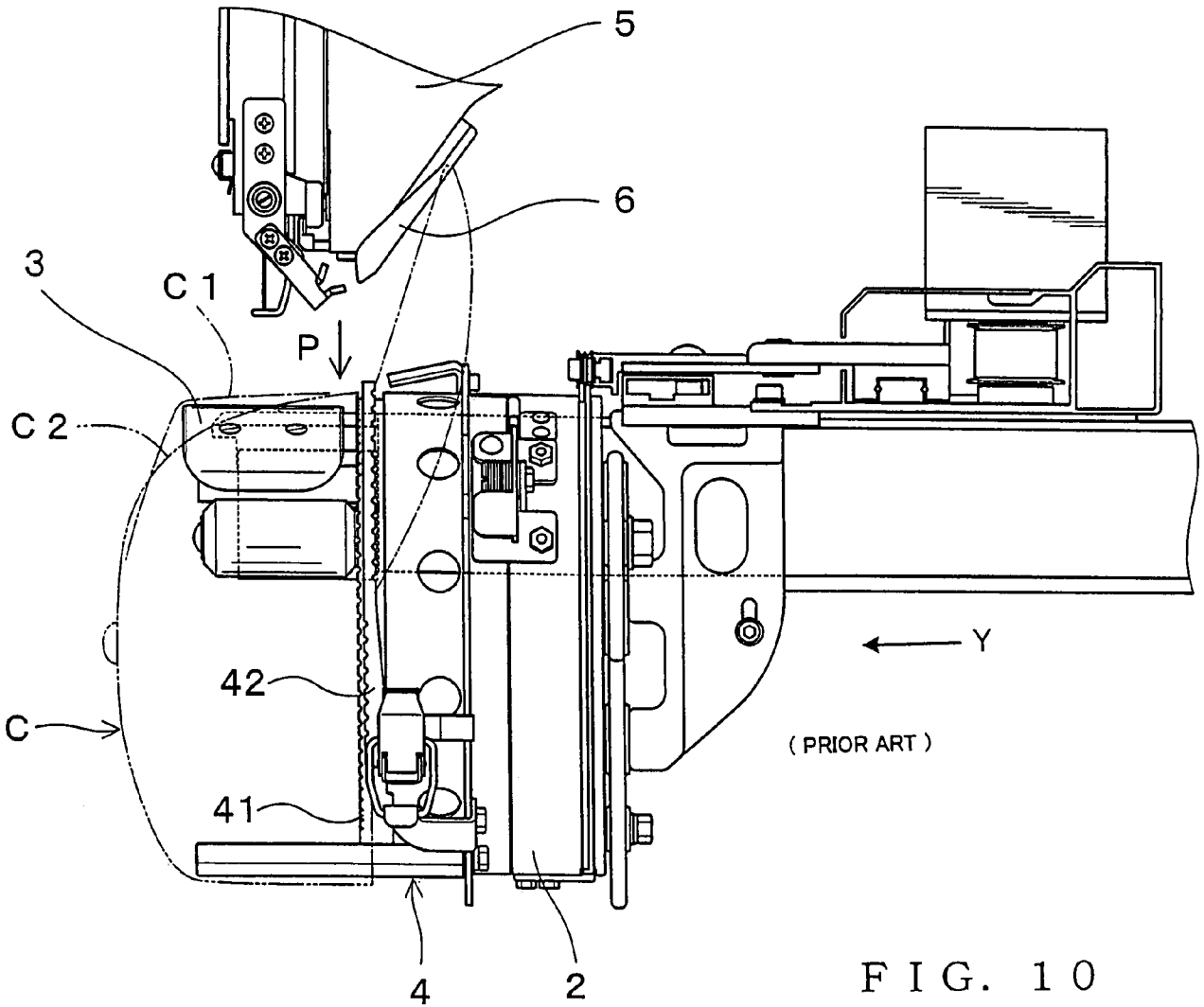
FIG. 10 is a side view showing a conventional cap attached to a drive ring.

FIG. 1 is a side view of a workpiece holding frame (cap frame) 10 employed in an embodiment of the present invention, which particularly shows the workpiece holding frame 10 attached to a drive ring 2 in a similar manner to FIG. 10. On this holding frame (cap frame) 10 is set a sewing workpiece (hereinafter "cap C") with a predetermined sewing reference line R (typically, horizontal line of an opening free end portion) of the cap C inclined at a predetermined angle δ relative to a rotational circumferential direction X (i.e., plane perpendicular to the rotation axis) of the workpiece holding frame (cap frame) 10. The "horizontal line" is so called here because the free end of the cap C lies in a substantial horizontal direction when the cap C is put on a person. Namely, the workpiece holding frame 10 includes a cylindrical supporting frame section 11 having an inclined end 11*a* to which the opening (free end) portion of the cap C is attachable obliquely at the predetermined angle δ relative to the rotational circumferential direction X (i.e., plane perpendicular to the rotation axis) of the holding frame 10, and a band-shaped pressing frame section 12 for pressing and holding the periphery of the opening portion of the cap C against the inclined end 11*a* of the supporting frame section 11. The supporting frame section 11 and pressing frame section 12 constitute mounting members for setting the sewing workpiece (cap C) on the workpiece holding frame 10. Slip-preventing concave/convex portions are formed continuously or intermittently on the inclined end 11*a* of the supporting frame section 11, and the pressing frame section 12 too is inclined in conformity with the inclined end 11*a*. Note that the pressing frame section 12 too may have slip-preventing concave/convex portions formed continuously or intermittently thereon. The workpiece holding frame (cap frame) 10 is driven, via a drive mechanism as shown in FIG. 9, in an X-axis direction (rotation of the drive ring 2) and Y-axis direction (forward/rearward movement of the drive ring 2).

Figure 11:
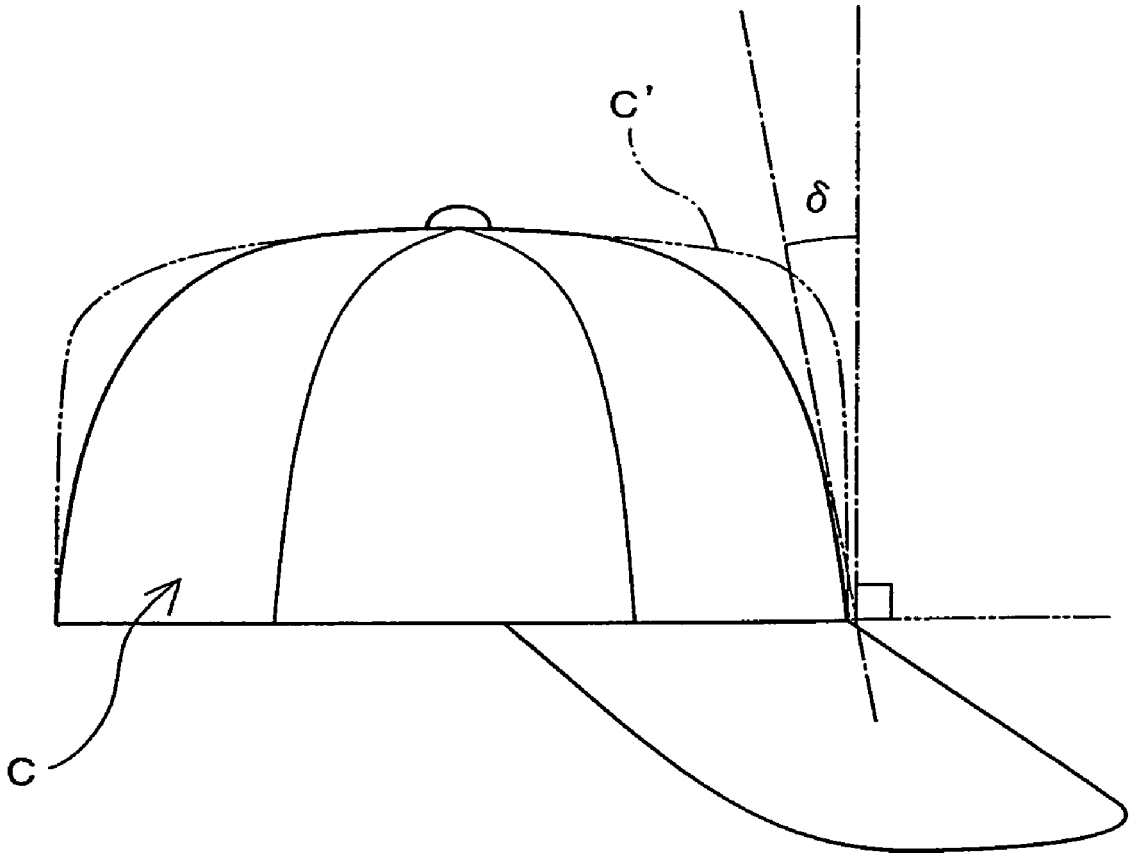
FIG. 11 is a side view showing an example of a cap with a peripheral surface of a cap crown inclined at a given angle.

Inclination angle (δ) of the end 11*a* of the supporting frame section 11 corresponds to the inclination angle δ of the peripheral surface of the crown of the cap C relative to the vertical as shown in FIG. 11. Thus, when such a type of cap C is embroidered by being set on the workpiece holding frame 10, the instant embodiment can effectively prevent a near-top region of the peripheral surface of the cap crown from being strongly pressed against the front edge of a support plate 3 that is fixed within an interior space of the drive ring 2 for supporting the cap C. As a consequence, it is possible to prevent contact resistance between the inner surface of the cap C and the support plate 3, thereby avoiding a thread breakage and defective product. However, because the cap C is set on the workpiece holding frame 10 with the predetermined sewing reference line R (i.e., horizontal line of the opening free end portion of the cap C) inclined at the predetermined angle δ relative to the rotational circumferential direction X of the workpiece holding frame 10, a sewn pattern would undesirable deform, as illustrated in (b) of FIG. 7, if the sewing is performed using original sewing pattern data created on the assumption that the sewing reference line R is not inclined relative to the rotational circumferential direction X. Because the inclination angle δ of the peripheral surface of the crown of the cap C, i.e. sewing workpiece, relative to the vertical generally differs depending on the type of the sewing workpiece, the instant embodiment employs a workpiece holding frame 10 where the inclination angle (δ) of the inclined end 11*a* of the supporting frame section 11 agrees with the inclination angle δ of the peripheral surface of the crown of the cap C, i.e. sewing workpiece, to be set on the holding frame 10.

Figure 2:
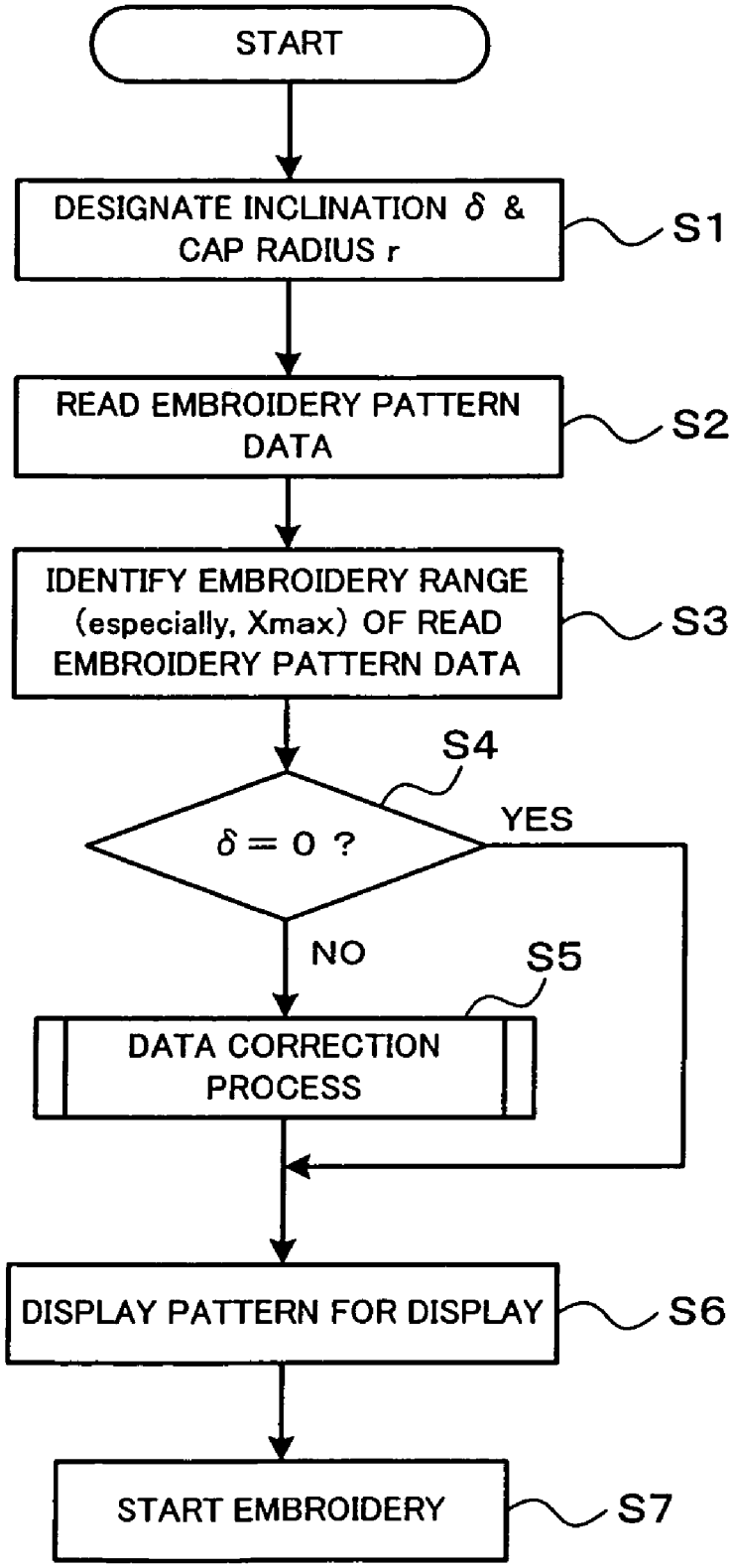
FIG. 2 is a flow chart of a pre-embroidery-sewing process performed in the embodiment of the sewing machine or data creation apparatus.
Figure 3:
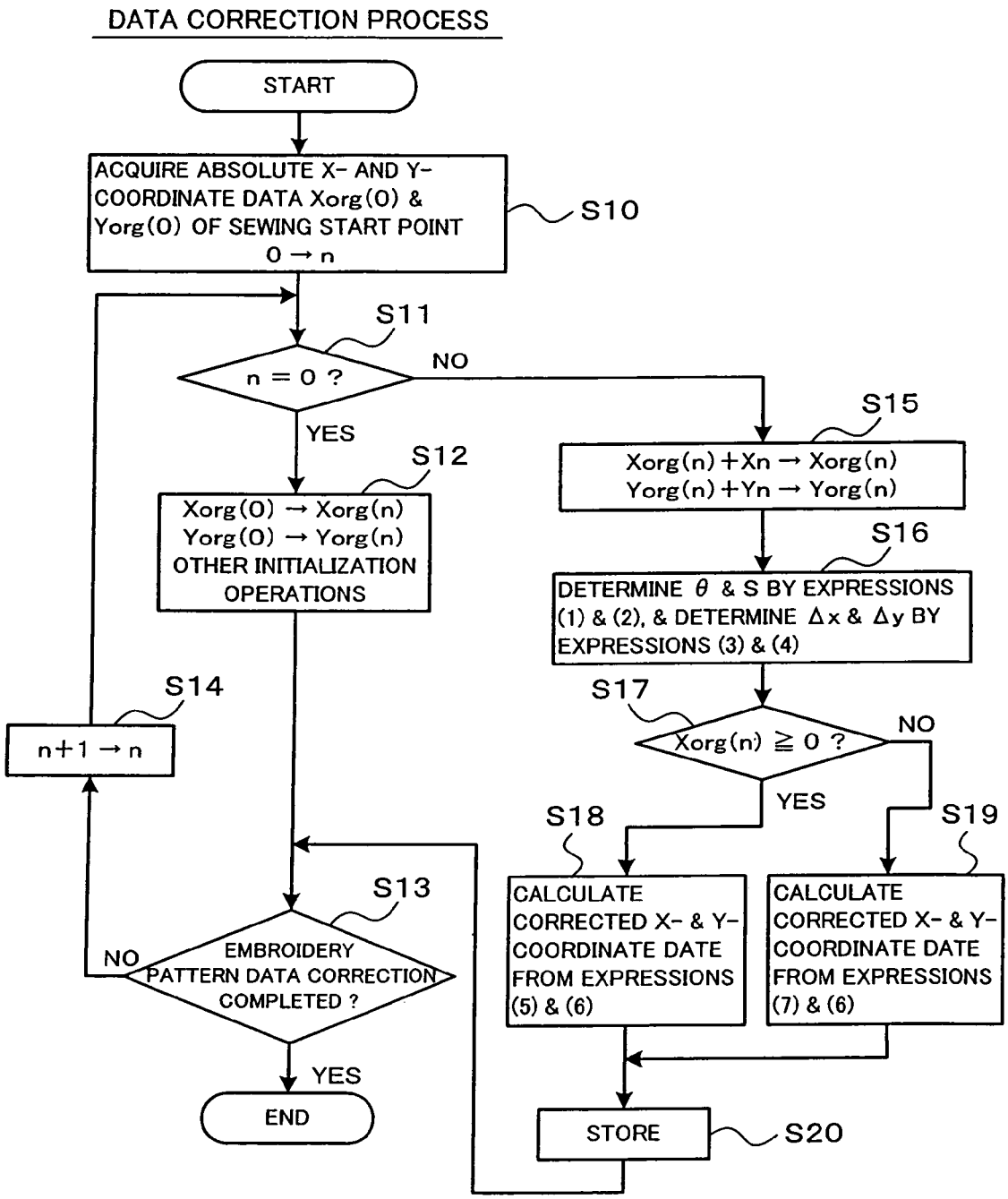
FIG. 3 is a flow chart showing details of a data correction process shown in FIG. 2.

In the instant embodiment, processes as shown in FIGS. 2 and 3 are performed, by a control device (e.g., CPU) provided in the sewing machine, to correct the sewing pattern data so that sewing can be performed in accordance with the corrected sewing pattern data.

Figure 4:
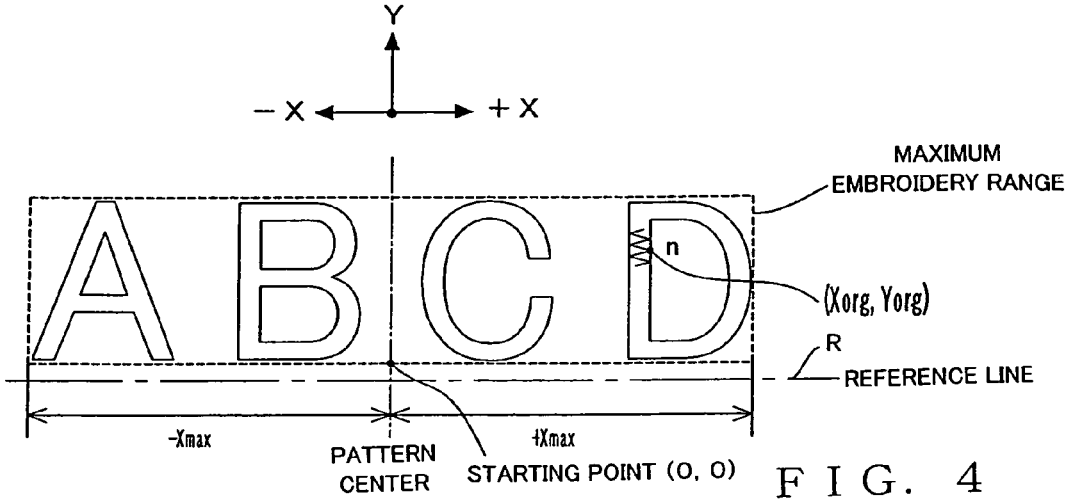
FIG. 4 is a diagram showing an example of an embroidery pattern achievable by original sewing pattern data.
Figure 5:
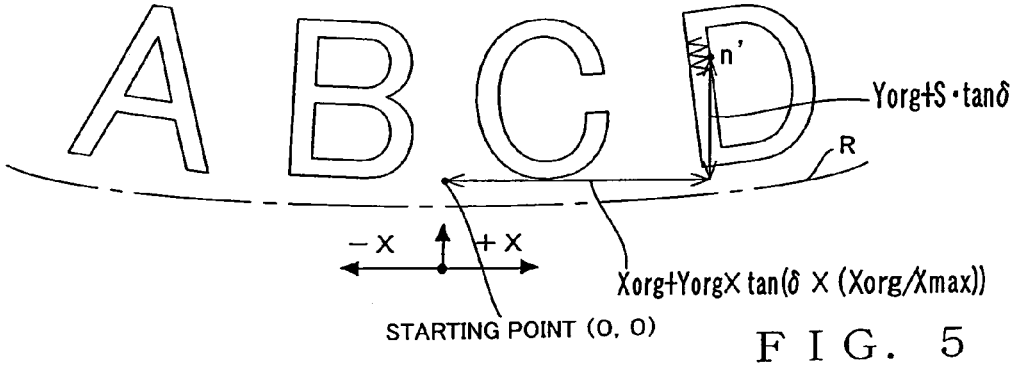
FIG. 5 is a diagram explanatory of corrected sewing pattern data obtained by correcting the original sewing pattern data.
Figure 6:
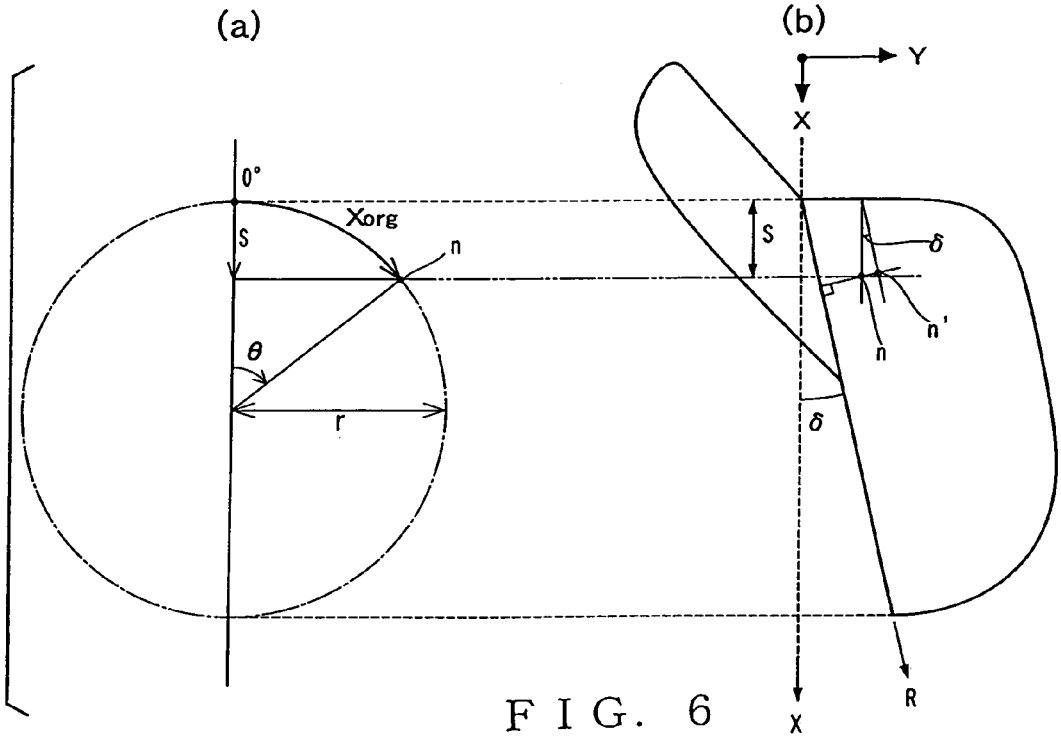
FIG. 6 is a diagram explanatory of coordinate conversion principles on which the embodiment is based.

The following paragraphs conceptually describe a sewing pattern data correction scheme employed in the instant embodiment of the present invention, with reference to FIGS. 4-6.

FIG. 4 shows an example of an embroidery pattern achievable by original sewing pattern data, which comprises a horizontal string of four alphabetical letters, "A B C D". The embroidery pattern is embroidered, for example, onto a predetermined peripheral surface portion, e.g. frontal surface portion, of the cap C. In FIG. 4, there is also indicated the predetermined sewing reference line R (horizontal line of the opening free end portion) of the cap C that is an embroidering workpiece to be sewn in this case; essentially, the embroidery pattern having been sewn on the cap C and the sewing reference line R should lie parallel to each other. FIG. 5 is explanatory of corrected sewing pattern data obtained by correcting the original sewing pattern data of FIG. 4 in accordance with the sewing pattern data correction scheme. FIG. 5 is a kind of development view, and the rotational circumferential direction X of the workpiece holding frame 10 corresponds to an X-axis direction of the sewing pattern data represented by two-axis (i.e., X-Y) coordinates while a direction perpendicular to the rotational circumferential direction X of the workpiece holding frame 10 corresponds to a Y-axis direction of the sewing pattern data. Because the sewing reference line R is inclined relative to the rotational circumferential direction X as viewed sideways, the reference line R of the cap C (i.e., horizontal line of the opening free end portion of the cap C) appears as a curved line in the development view of FIG. 5. As seen from the figure, the sewing pattern data are corrected through predetermined coordinate conversion calculations with such a characteristic as to curve the embroidery pattern in accordance with the curved sewing reference line R. In this way, the embroidery pattern having been sewn on the cap C can assume a desired linearity.

The original sewing pattern data are two-axis coordinate data with the X-coordinate data representing an amount of movement in the rotational circumferential direction X of the holding frame 10 and the Y-coordinate data representing an amount of movement along the axis of the rotation of the holding frame 10; a two-axis coordinate data value of a needle drop point (or sewing position) n of an nth stitch is indicated here by Xorg, Yorg (see FIG. 4). "n" in FIG. 5 indicates a modified needle drop point n of the nth stitch determined by correcting the two-axis coordinate data value Xorg, Yorg of the needle drop point. As known in the art, actual sewing pattern data are not in the form of absolute coordinate data, but in the form of stitch-by-stitch relative coordinate data (i.e., data indicative of sewing widths, in the X- and Y-axis directions, of the individual stitches (i.e., sewing widths of X and Y components of the individual stitches). The following description will be given on the assumption that the sewing pattern data in the form of stitch-by-stitch relative coordinate data have been converted into absolute coordinate data from a predetermined starting point (e.g., embroidery starting position).

The correcting calculations (coordinate conversion calculations) are performed taking into account a maximum embroidery range of the embroidery pattern in question, and a maximum value in the X-coordinate direction is represented by Xmax. For simplification of the description, the X-Y coordinates of the sewing pattern data are represented by absolute X-Y coordinates using, as the staring point (0, 0), a predetermined position within the embroidery range. The staring point (0, 0) generally corresponds to an original point of the inclination angle δ and is used as the starting point of the coordinate conversion. In the illustrated example of FIG. 4, a middle lowest position of the embroidery range is set as the staring point (0, 0). The maximum value Xmax in the X-coordinate direction indicates a distance (+Xmax or −Xmax) between the staring point (0, 0) and the maximum value Xmax in the X-coordinate direction. The data correction is performed in accordance with a characteristic symmetrical with respect to a centerline passing the staring point (0, 0) between left and right portions. Whereas the data correction will be described below only for the right portion (i.e., +X region), the data correction for the left portion (i.e., −X region) is performed similarly.

For each of the X and Y axes, the sewn result will have greater deviations as the distances, from the starting point (0, 0), of the sewing positions indicated by the sewing data increase. Thus, correcting values are determined, in accordance with correction functions (coordinate conversion functions) specific to the X and Y components), to eliminate the deviations.

(a) of FIG. 6 shows the rotational circumference of the workpiece holding frame 10 (i.e., circumference of the opening portion of the crown of the cap C, and the X-coordinate data value Xorg of the needle drop point n of the nth stitch, indicated by the original sewing pattern data, is present on this rotational circumference. If a radius of rotation of the workpiece holding frame 10 (namely, radius of curvature of the cap C or sewing workpiece) is indicated by r, an angle of rotation (radian) corresponding to the X-coordinate data value Xorg can be expressed by $$\theta = Xorg/r \tag{1}$$

Further, a length indicated by S in the figure can be expressed by $$\begin{aligned} S &= r \times (1 - \cos\theta) \\ &= r \times \{(1 - \cos\theta(Xorg/r)\} \end{aligned} \tag{2}$$

(b) of FIG. 6 is a side view of (a) of FIG. 6. X and Y components of a difference between the uncorrected needle drop point n and the corrected needle drop point n' are an X-coordinate correction value Δx and Y-coordinate correction value Δy, which can be obtained by the following mathematical expressions with the inclination angle δ of the cap C as a variable:

$$\Delta x = Yorg \times \tan\{\delta \times (Xorg/Xmax)\} \tag{3}$$

$$\Delta y = S \times \tan\delta \tag{4}$$

Here, the X-coordinate correction value Δx is also a function of the value Yorg, and as the value Yorg increases, the X-coordinate correction value Δx increases. Further, as will be later set forth, the X-coordinate correction value Δx serves as a subtractive value for the value Xorg, so as to realize the relationship that the subtractive correction value of the X-coordinate value increases as the Y-coordinate value increases as shown in FIG. 5. Further, the X-coordinate correction value Δx is also a function of the value Xorg and realizes the relationship that the subtractive correction value of the X-coordinate value increases as the value Xorg approaches the maximum value Xmax.

Furthermore, the Y-coordinate correction value Δy is also a function of the length S, i.e. value Xorg, and as the value Xorg increases, the Y-coordinate correction value Δy increases. The Y-coordinate correction value Δy serves as an additive value for the value Yorg, so as to realize the relationship that the additive correction value of the Y-coordinate value increases as the X-coordinate value increases as shown in FIG. 5.

The X-Y coordinate data indicative of the corrected needle drop point n' can be given by the following mathematical expressions:

$$\begin{aligned} X &= Xorg - \Delta x \\ &= Xorg - Yorg \times \tan\{\delta \times (Xorg/X\max)\} \end{aligned} \tag{5}$$

$$\begin{aligned} Y &= Yorg - \Delta y \\ &= Yorg + r \times \{1 - \cos(Xorg/r)\} \times \tan\delta \end{aligned} \tag{6}$$

Mathematical expression (5) above is an expression when the value Xorg is in a positive region with respect to the starting point. When the value Xorg is in a negative region, Δx is added, as indicated in the following mathematical expression, to decrease the absolute value of Xorg.

$$\begin{aligned} X &= Xorg + \Delta x \\ &= Xorg + Yorg \times \tan\{\delta \times (Xorg/X\max)\} \end{aligned} \tag{7}$$

Figure 7:
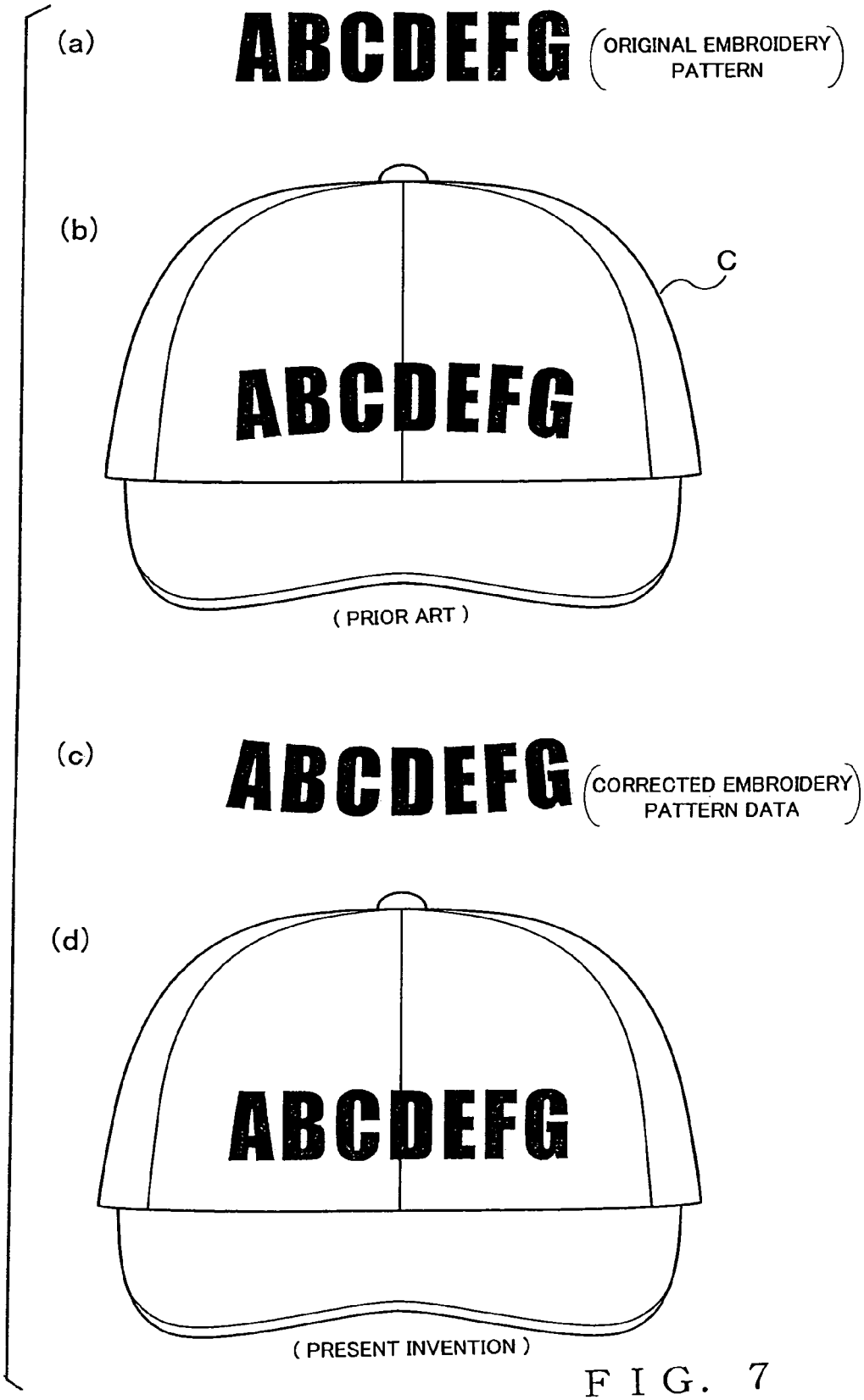
FIG. 7 is a diagram comparatively showing a pattern sewn with conventional sewing pattern data with no data correction and a pattern sewn with sewing pattern data corrected in accordance with the present invention.

The above-described data correction is performed on the data of all of the stitches of the embroidery pattern in question. Embroidery pattern achieved by the corrected sewing pattern data obtained by such correction is curved along the curve of the sewing reference line R of the cap C (horizontal line of the opening free end portion of the cap C) as seen in FIG. 5. However, if the sewing reference line R of the cap C (horizontal line of the opening free end portion of the cap C) is adjusted into a horizontal straight line, the embroider pattern having been sewn onto the cap C can also assume a desired linearity. (c) of FIG. 7 is a development view, similar to FIG. 5, which shows an example of an embroidery pattern provided by sewing pattern data corrected in accordance with the present invention, and (d) of FIG. 7 is a front view of a finished cap C having been embroidered using the sewing pattern data corrected in accordance with the present invention. As seen in (d) of FIG. 7, the embroider pattern having been sewn onto the cap C in accordance with the present invention has a good finish without looking deformed as viewed from the front, Now, with reference to FIGS. 2 and 3, the following paragraphs describe example operational sequences of processes performed, by the control device (e.g., CPU) provided in the sewing machine, for correcting sewing pattern data so that sewing can be performed in accordance with the corrected sewing pattern data.

FIG. 2 is a flow chart of a pre-embroidery-sewing process. First, at step S1, an inclination angle δ and radius r of a cap C to be set on the cap frame (workpiece holding frame 10) for desired embroidery pattern sewing are designated by a human operator through operation on an operation panel (not shown). Then, the control device reads desired sewing pattern data to be used for the embroidery pattern sewing (i.e., original embroidery pattern data before being subjected to the data correction according to the present invention), at step S2. At following step S3, an X-Y embroidery range (particularly, a maximum value Xmax in the X-coordinate direction) of the embroidery pattern is identified from the thus-read embroidery pattern data. Then, a determination is made, at step S4, as to whether or not the designated inclination angle δ is zero. If the designated inclination angle δ is not zero as determined at step S4, it means that there is a need to correct the original embroidery pattern data in accordance with the designated inclination angle δ, so that the control device moves on to step S5 in order to perform a data correction process. If the designated inclination angle δ is zero, on the other hand, it means that there is no need to correct the original embroidery pattern data in accordance with the designated inclination angle δ, so that the control device jumps over step S5 to step S6.

FIG. 3 is a flow chart showing a detailed operational sequence of the data correction process performed at step S5. The original or uncorrected sewing pattern data are not in the form of absolute coordinate data, but in the form of stitch-by-stitch relative coordinate data (i.e., data indicative of sewing widths, in the X- and Y-axis directions, of the individual stitches). The sewing pattern data can be read out in accordance with the stitch number n. In the following description, the relative X- and Y-coordinate data read out in accordance with the stitch number n will be indicated by Xn and Yn.

First, at step S10 of the data correction process, the control device acquires absolute X- and Y- coordinate data Xorg(0) and Yorg(0) of a sewing start point of the original or uncorrected embroidery pattern data (or sewing pattern data), which are in the form of relative coordinate data, read out at step S2 of FIG. 2. With the X-Y embroidery range of the embroidery pattern identified at step S3 of FIG. 2, it is possible to identify relationship between the staring point (0, 0) corresponding to a predetermined position (middle lowest position) of the embroidery range and the sewing start point, so that the absolute X- and Y-coordinate data Xorg(0) and Yorg(0) of the sewing start point relative to the staring point (0, 0) can be obtained with ease. Then, the stitch number n is set to "0" corresponding to the sewing start point.

At next step S11, a determination is made as to whether or not the stitch number n is "0". With an affirmative (i.e., YES) determination at step S11, the control device proceeds to step S12, where the absolute X- and Y-coordinate data Xorg(0) and Yorg(0) of the sewing start point are set as absolute X- and Y-coordinate data Xorg(n) and Yorg(n) of the current stitch. Further, other necessary initialization operations are carried out.

At next step S13, a determination is made as to whether the embroidery pattern data correction has been completed. If the embroidery pattern data correction has not yet been completed (NO determination at step S13), the control device goes to step S14 in order to increment the stitch number n by one. After that, the control device reverts to step S11. Then, with a NO determination at step S11, the control device branches to step S15.

At step S15, the relative X- and Y-coordinate data Xn and Yn read out in accordance with the stitch number n are added to the data Xorg(n) and Yorg(n), respectively, and the results of the addition are set as absolute X- and Y-coordinate data Xorg(n) and Yorg(n) of the new current stitch.

At following step S16, not only the absolute X- and Y-coordinate data Xorg(n) and Yorg(n) of the current stitch are substituted into mathematical expressions (1)-(4) above as Xorg and Yorg, respectively, but also the inclination angle δ and radius r of the cap C designated at step S1 of FIG. 2 are substituted into mathematical expressions (1)-(4). Then, arithmetic operations are carried out in accordance with these mathematical expressions (1)-(4), to there determine the angle θ and length S and correction values Δx and Δy for the absolute X- and Y-coordinates of the current stitch.

At next step S17, the absolute X-coordinate value of the current stitch is equal to or greater than "0" (i.e., positive value) or not (i.e., negative value). With an affirmative (YES) determination at step S17, arithmetic operations are carried out in accordance with mathematical expressions (5) and (6) above, to determine corrected absolute X- and Y-coordinates (step S18). With a NO determination at step S17, on the other hand, arithmetic operations are carried out in accordance with mathematical expressions (7) and (6) above, to determine corrected absolute X- and Y-coordinates (step S19). At following step S20, the corrected absolute X- and Y-coordinates are stored in memory. Then, the control device goes to step S13 and then to step S14 in response to a NO determination at step S13 in order to increment the stitch number n by one. After that, the control device reverts to step S11 to repeat the above-described operations of steps S15-S20. Once the correction of the embroidery data of all of the stitches is completed, it is determined at step S13 that the embroider pattern data correction has been completed, and thus, this data correction process is brought to an end.

In the aforementioned manner, the sewing pattern data are corrected on a stitch-by-stitch basis, and the thus-corrected sewing pattern data (i.e., corrected absolute X- and Y-coordinate data) are stored in memory. Note that the corrected sewing pattern data (i.e., corrected absolute X- and Y-coordinate data), stored at step S20, may be further converted into stitch-by-stitch relative X- and Y-coordinate data for storage as corrected relative X- and Y-coordinate data.

Referring back to FIG. 2, the embroidery pattern is displayed at step S6 for preview. Namely, if the pattern data have not yet been corrected, an uncorrected embroidery pattern is displayed for preview as illustrated in (a) of FIG. 7, while, if the pattern data have already been corrected, a corrected embroidery pattern is displayed for preview as illustrated in (c) of FIG. 7. Lastly, an embroidery sewing start operation (where, for example, operation of an embroidery sewing start switch is received) is carried out, after which the process of FIG. 2 is brought to an end. Then, once the embroidery sewing is started, the corrected sewing pattern data, stored as noted above, are read out in the order of the stitch numbers, on the basis of which the desired embroidery sewing process is performed.

In the above-described embodiment, the data correction process is performed collectively prior to initiation of the embroidery sewing process. However, the present invention is not so limited, and the data correction process may be performed in real time during the course of the embroidery sewing process. In such a case, the pattern data of one stitch may be corrected upon completion of sewing of the preceding stitch, or the pattern data of several stitches may be corrected collectively in advance at suitable timing during the sewing. Alternatively, the embroidery sewing process may be initiated prior to completion of the pattern data correction process. In short, it is only necessary that the data correction of a given stitch be completed by immediately before sewing of the given stitch.

Further, the data correction process of the present invention (more specifically, operations of FIGS. 2 and 3 except for the operations of step S7) may be performed by an embroidery data creation apparatus, such as a punching machine, independent of the sewing machine, instead of being performed by the control device provided in the sewing machine. For that purpose, a program for carrying out the operations of FIGS. 2 and 3 except for the operations of step S7 may be incorporated into the embroidery data creation apparatus, such as a punching machine, so that the embroidery data creation apparatus can create an embroidery sewing pattern corrected in accordance with the inclination angle δ of the sewing workpiece (cap C). In such a case, the sewing machine is supplied with the already-corrected sewing pattern data and performs desired sewing on the basis of the supplied corrected sewing pattern data.

Further, the data correction process of the present invention of FIGS. 2 and 3 may be implemented by a control device comprising dedicated hardware rather than a software program. Further, the correction functions are not limited to those mentioned above in relation to the preferred embodiment and may be modified as necessary. To be short, the correction functions may be any suitable functions that permit data correction such that a pattern corresponding to sewing pattern data can be formed substantially parallel to the sewing reference line R.

Figure 8:
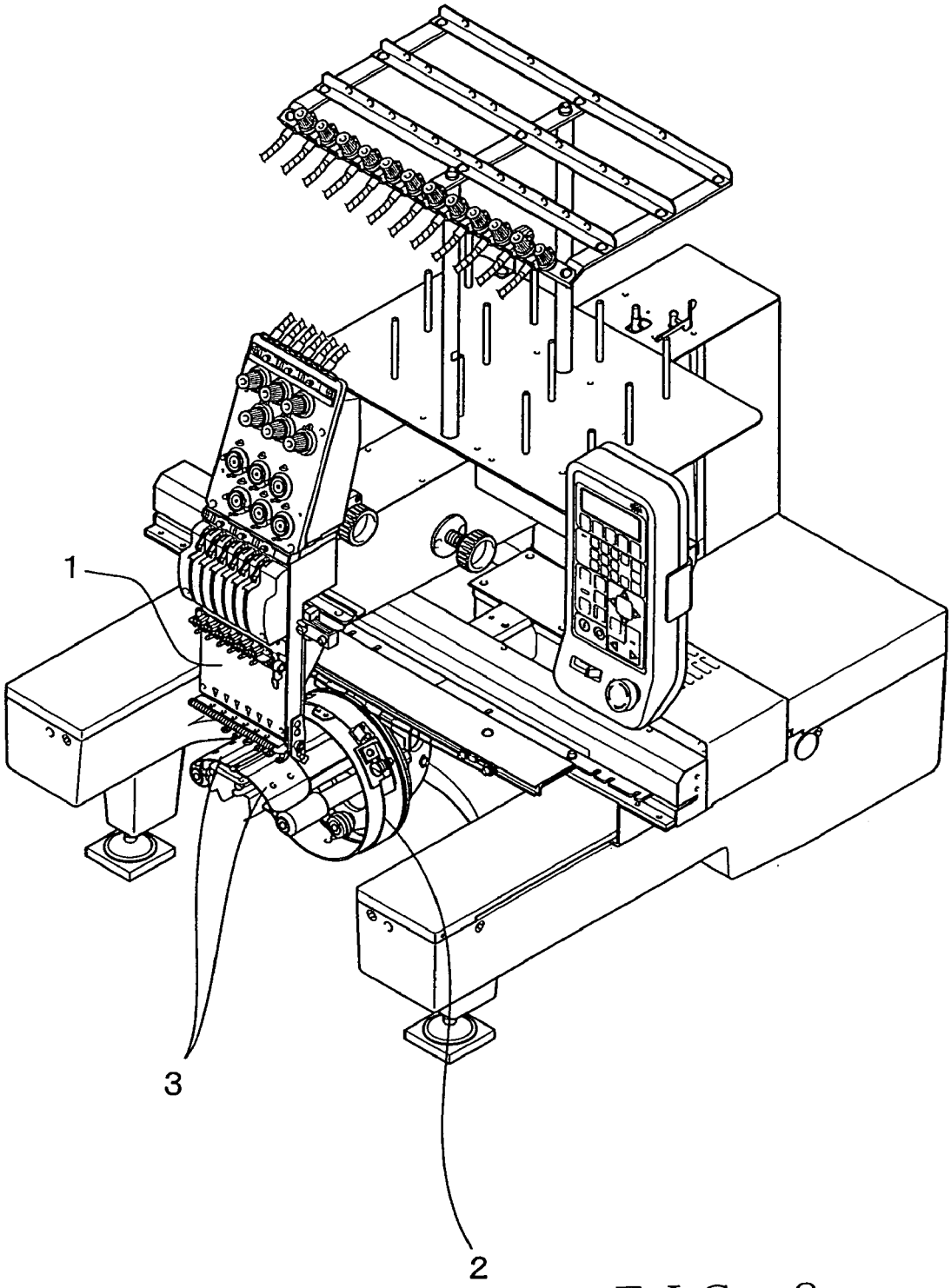
FIG. 8 is a perspective view showing an outer appearance of an example of a conventional single-head compact sewing machine to which a cap frame is attachable.

Of course, the basic principles of the present invention are applicable to multi-head sewing machines as well as single-head sewing machines like that illustrated in FIG. 8. Further, the basic principles of the present invention are applicable to sewing of ornamental members, such as sequins and/or pieces of strings, in addition to sewing of a thread embroidery. The present invention can also be suitably applied to sewing where any other desired workpieces than caps, having a curved surface, are set and embroidered on the rotary holding frame in an inclined posture. Furthermore, the present invention are suitably applicable to sewing of a type where the holding frame is rotated (driven along the X axis) in accordance with X components of sewing data and the machine head and rotary hook base are driven in the front-rear direction (driven along the Y axis) in accordance with Y components of the sewing data.

What is claimed is:

1. A sewing machine comprising:

a holding frame for setting thereon a sewing workpiece having a curved surface, said holding frame being rotatable and linearly movable relative to a sewing position;

a drive mechanism for relatively rotating and linearly moving said holding frame in accordance with desired sewing pattern data;

a mounting member adapted to set the sewing workpiece, having the curved surface, on said holding frame in such a manner that a predetermined sewing reference line of the sewing workpiece forms an inclination of a given angle (δ) relative to a plane perpendicular to a rotation axis of said holding frame; and a data correction section that corrects the desired sewing pattern data in accordance with a predetermined correction function with the given angle (δ) as a variable, wherein a desired sewing pattern is sewn onto the sewing workpiece by said holding frame being relatively rotated and linearly moved in accordance with the sewing pattern data corrected by said data correction section.

2. A sewing machine as claimed in claim 1 wherein said mounting member includes:

a supporting frame section having an inclined end inclined at the given angle (δ) relative to the plane perpendicular to the rotation axis of said holding frame, said supporting frame section receiving and supporting the sewing workpiece in such a manner that the sewing reference line of the sewing workpiece lies along the inclined end; and a pressing frame section for holding the sewing workpiece, supported on the supporting frame section, by pressing the sewing workpiece against the supporting frame section.

3. A sewing machine as claimed in claim 1 wherein the predetermined correction function further includes a radius (r) of said holding frame as a variable, and said data correction section corrects the desired sewing pattern data in accordance with the predetermined correction function with the given angle (δ) and radius (r) of said holding frame as variables.

4. A sewing machine as claimed in claim 1 wherein the sewing workpiece is a hat, and the sewing reference line is a free end of the hat, and wherein the given angle (δ) corresponds generally to an inclination angle, relative to a vertical, of a portion of the hat extending upwardly from the free end of a sewing surface region of the hat.

5. A sewing machine as claimed in claim 4 wherein correction of the desired sewing pattern data in accordance with the predetermined correction function is performed with a characteristic symmetrical with respect to a center between left and right portions of a sewing pattern region represented by the sewing pattern data.

6. A sewing machine as claimed in claim 1 wherein the predetermined correction function has a characteristic to modify the desired sewing pattern data in accordance with the inclination formed by the predetermined sewing reference line.

7. A sewing machine as claimed in claim 1 wherein the sewing pattern data are two-axis coordinate data with X-coordinate data representing an amount of movement in a rotational direction of said holding frame and Y-coordinate data representing an amount of movement in a direction of the rotation axis of said holding frame, and wherein, when a radius of said workpiece holding frame or radius of curvature of the sewing workpiece is indicated by r and a maximum value in an X-coordinate direction is indicated by Xmax, the predetermined correction function determines corrected two-axis coordinate data values X and Y by correcting two-axis coordinate data values Xorg and Yorg of the desired sewing pattern data in accordance with following mathematical expressions:

$$X = X\text{org} - Y\text{org} \times \tan\{\delta \times (X\text{org}/X\text{max})\}$$

$$Y = Y\text{org} + r \times \{1 - \cos(X\text{org}/r)\} \times \tan\delta.$$

8. A data creation apparatus for a sewing machine, the sewing machine including: a holding frame for setting thereon a sewing workpiece having a curved surface, the holding frame being rotatable and linearly movable relative to a sewing position; a drive mechanism for relatively rotating and linearly moving the holding frame in accordance with desired sewing pattern data; and a mounting member adapted to set the sewing workpiece, having the curved surface, on the holding frame in such a manner that a predetermined sewing reference line of the sewing workpiece forms an inclination of a given angle (δ) relative to a plane perpendicular to a rotation axis of the holding frame, said data creation apparatus comprising a data correction section that corrects the desired sewing pattern data in accordance with a predetermined correction function with the given angle (δ) as a variable, wherein the sewing pattern data corrected by said data correction section are supplied to the sewing machine, so that the sewing machine sews a desired sewing pattern onto the sewing workpiece, set on the holding frame with the inclination of the given angle (δ), in accordance with the corrected sewing pattern data;

wherein the sewing pattern data are two-axis coordinate data with X-coordinate data representing an amount of movement in a rotational direction of said holding frame and Y-coordinate data representing an amount of movement in a direction of the rotation axis of the holding frame, and wherein, when a radius of the workpiece holding frame or radius of curvature of the sewing workpiece is indicated by r and a maximum value in an X-coordinate direction is indicated by Xmax, the predetermined correction function determines corrected two-axis coordinate data values X and Y by correcting two-axis coordinate data values Xorg and Yorg of the desired sewing pattern data in accordance with following mathematical expressions:

$$X = X\text{org} - Y\text{org} \times \tan\{\delta \times (X\text{org}/X\text{max})\}$$

$$Y = Y\text{org} + r \times \{1 - \cos(X\text{org}/r)\} \times \tan\delta.$$

9. A non-transitory computer-readable medium including a program for causing a computer to perform a procedure for correcting desired sewing pattern data for a sewing machine that performs sewing in accordance with the desired sewing pattern data by setting a sewing workpiece, having a curved surface, on a holding frame rotatable and linearly movable relative to a sewing position and then relatively rotating and linearly moving the holding frame in accordance with the desired sewing pattern data, the sewing workpiece being capable of being set on the holding frame in such a manner that a predetermined sewing reference line of the sewing workpiece forms an inclination of a given angle (δ) relative to a plane perpendicular to a rotation axis of the holding frame, said program causing the computer to perform the procedure for correcting the desired sewing pattern data in accordance with a predetermined correction function with the given angle (δ) with a variable, the corrected sewing pattern data being supplied to the sewing machine so that a desired sewing pattern is sewn onto the sewing workpiece, set on the holding frame with the inclination of the given angle (δ), by the holding frame of the sewing machine being relatively rotated and linearly moved in accordance with the corrected sewing pattern data;

wherein the sewing pattern data are two-axis coordinate data with X-coordinate data representing an amount of movement in a rotational direction of said holding frame and Y-coordinate data representing an amount of movement in a direction of the rotation axis of the holding frame, and wherein, when a radius of the workpiece holding frame or radius of curvature of the sewing workpiece is indicated by r and a maximum value in an X-coordinate direction is indicated by Xmax, the predetermined correction function determines corrected two-axis coordinate data values X and Y by correcting two-axis coordinate data values Xorg and Yorg of the desired sewing pattern data in accordance with following mathematical expressions:

$$X = X\text{org} - Y\text{org} \times \tan\{\delta \times (X\text{org}/X\text{max})\}$$

$$Y = Y\text{org} + r \times \{1 - \cos(X\text{org}/r)\} \times \tan\delta.$$

* * * * *